US009404351B2

(12) United States Patent
Noui-Mehidi

(10) Patent No.: US 9,404,351 B2
(45) Date of Patent: Aug. 2, 2016

(54) APPARATUS FOR DOWNHOLE WATER PRODUCTION CONTROL IN AN OIL WELL

(71) Applicant: Saudi Arabian Oil Company, Dhahran (SA)

(72) Inventor: Mohamed Nabil Noui-Mehidi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 211 days.

(21) Appl. No.: 14/196,042

(22) Filed: Mar. 4, 2014

(65) Prior Publication Data

US 2014/0246205 A1 Sep. 4, 2014

Related U.S. Application Data

(60) Provisional application No. 61/772,169, filed on Mar. 4, 2013.

(51) Int. Cl.

| | |
|---|---|
| ***E21B 43/12*** | (2006.01) |
| ***E21B 43/08*** | (2006.01) |
| ***E21B 34/08*** | (2006.01) |

(52) U.S. Cl.

CPC ..... *E21B 43/12* (2013.01); *E21B 34/08* (2013.01); *E21B 43/086* (2013.01)

(58) Field of Classification Search

CPC ..... E21B 34/08; E21B 43/12

See application file for complete search history.

(56) References Cited

U.S. PATENT DOCUMENTS

| | | | | |
|---|---|---|---|---|
| 2,257,523 | A | 9/1941 | Combs | |
| 7,409,999 | B2 | 8/2008 | Henrikson et al. | |
| 7,918,275 | B2 | 4/2011 | Clem | |
| 2004/0144544 | A1 | 7/2004 | Freyer | |
| 2007/0246407 | A1* | 10/2007 | Richards | E12B 43/08 210/97 |
| 2008/0041580 | A1 | 2/2008 | Freyer et al. | |
| 2008/0041582 | A1* | 2/2008 | Saetre | E21B 43/12 166/205 |
| 2009/0194289 | A1 | 8/2009 | Clem | |

FOREIGN PATENT DOCUMENTS

| | | | |
|---|---|---|---|
| GB | 2384508 | A | 7/2003 |
| WO | 2006015277 | A1 | 2/2006 |

OTHER PUBLICATIONS

PCT International Search Report and the Written Opinion of the International Searching Authority dated Jul. 8, 2014; International Application No. PCT/US2014/020222; International File Date: Mar. 4, 2014.

* cited by examiner

*Primary Examiner* — William P Neuder

(74) *Attorney, Agent, or Firm* — Bracewell LLP; Constance Gall Rhebergen

(57) ABSTRACT

This invention relates to controlling production fluids downhole in an oil well. More specifically, this invention relates to control of water and pressure downhole. Provided are apparatus for controlling production fluids and pressures and methods of using the apparatus to control production fluids and pressures.

19 Claims, 2 Drawing Sheets

APPARATUS FOR DOWNHOLE WATER PRODUCTION CONTROL IN AN OIL WELL

UTILITY PATENT APPLICATION

This application claims priority to U.S. Provisional Application Ser. No. 61/772,169 filed on Mar. 4, 2013, which is incorporated by reference in its entirety.

FIELD OF THE INVENTION

This invention relates to controlling production fluids downhole in an oil well. More specifically, this invention relates to control of water and pressure downhole.

BACKGROUND OF THE INVENTION

Water control and management downhole, as well as pressure equalization, are important to oil production and production optimization. There is a need for a reliable apparatus that can play both roles of pressure equalization and water control.

Water production control downhole is very crucial for the longevity of an oil well. It is very important to control the amount of water produced in each zone in an oil well and to also equalize the pressure in the wellbore to avoid aggressive drawdown. Decreasing water production will prevent production equipment from experiencing corrosive attacks and deterioration. Thus, decreasing water production will help improve the life of the production system by avoiding corrosion related problems.

Controlling water production downhole also allows better production optimization and increases the lifetime of an oil well. The benefits and costs are substantial since water control downhole will prevent work over operations such as side tracking.

SUMMARY

This invention relates to controlling production fluids downhole in an oil well. More specifically, this invention relates to control of water and pressure downhole.

In an aspect, the invention provides an apparatus capable of controlling pressure and production fluids in a circular pipe in a downhole region of a well bore. The apparatus includes a circular pipe that has at least one pipe orifice on a lower side of the circular pipe. The pipe orifice is operable to allow the flow of production fluids through the orifice into the circular pipe. Within the circular pipe is an inclined wall. The inclined wall has a plurality of flow control members positioned at different horizontal levels relative to the inclined wall. The flow control members each have a housing with an inner chamber and a buoyant element within the inner chamber of the housing. The buoyant element moves vertically within the inner chamber relative to the density of the production fluids. Each housing has a lower housing orifice and an upper housing orifice. Between the pipe orifice and the inclined wall is a space.

In another aspect, the invention provides a process of using the apparatus in a horizontal section of an oil well. The process includes permitting production fluids to flow through the pipe orifice and enter the space. The process further includes allowing the production fluids to enter the inner chamber of the housing of a lowest positioned flow control member on the inclined wall. Upon entering the inner chamber, the production fluids contact the buoyant element of the flow control member and urge the buoyant element into a position relative to the density of the production fluids. The position of the buoyant element ranges between the lower housing orifice and the upper housing orifice of the inner chamber of the housing such that the upper housing orifice is shut off from fluid communications when the buoyant element is urged to its highest position within the inner chamber.

DETAILED DESCRIPTION OF THE INVENTION

Figure 1:
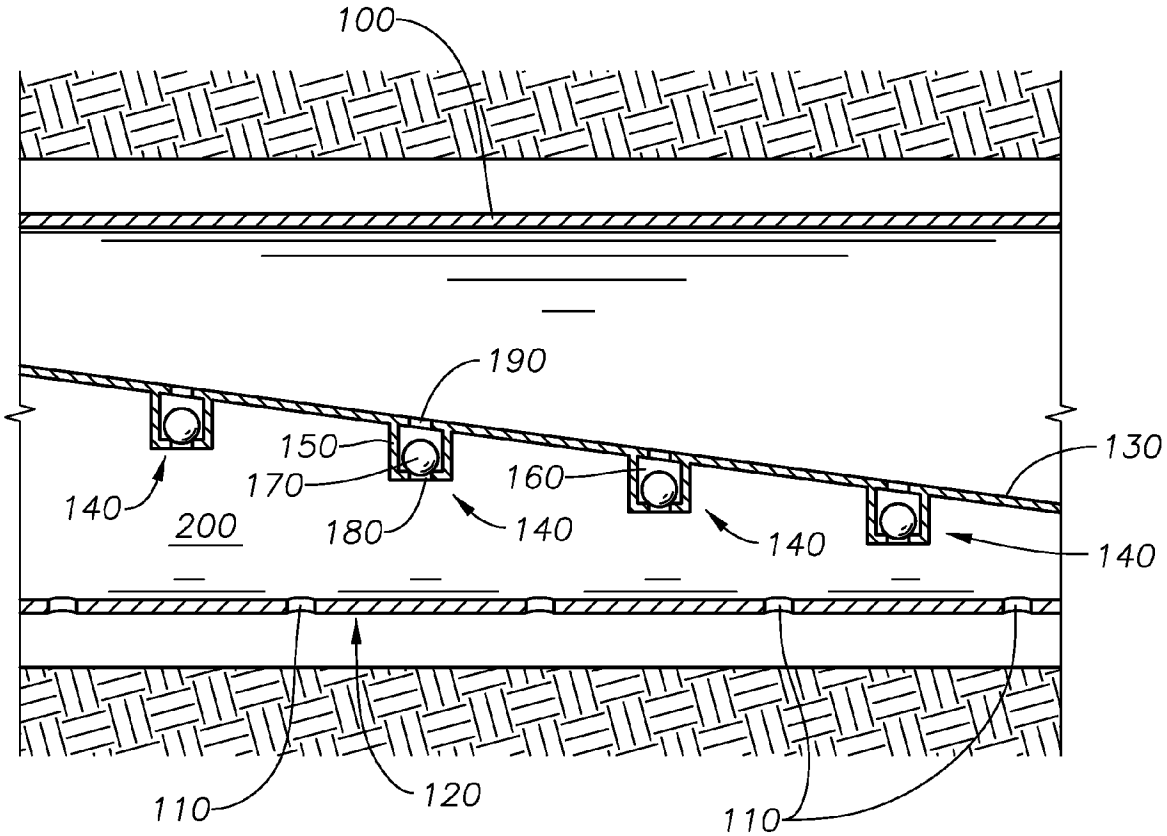
FIG. 1 shows an embodiment of a vertical cross section of an apparatus capable of controlling pressure and production fluids in a circular pipe.

Although the following detailed description contains many specific details for purposes of illustration, it is understood that one of ordinary skill in the art will appreciate that many examples, variations and alterations to the following details are within the scope and spirit of the invention. Accordingly, the exemplary embodiments of the invention described herein and provided in the appended figures are set forth without any loss of generality, and without imposing limitations, on the claimed invention.

In an aspect, the invention provides an apparatus capable of controlling pressure and production fluids in a circular pipe in a downhole region of a well bore. The apparatus includes a circular pipe that has at least one pipe orifice on a lower side of the circular pipe. The pipe orifice is operable to allow the flow of production fluids through the orifice into the circular pipe. Within the circular pipe is an inclined wall. The inclined wall has a plurality of flow control members positioned at different horizontal levels relative to the inclined wall. The flow control members each have a housing with an inner chamber and a buoyant element within the inner chamber of the housing. The buoyant element moves vertically within the inner chamber relative to the density of the production fluids. Each housing has a lower housing orifice and an upper housing orifice. Between the pipe orifice and the inclined wall is a space.

The buoyant elements move up and down in response to the density of the production fluids flowing through the circular pipe. In general, production fluids can include water and oil. In most cases, an interface forms between the oil and water that differentiates between them. Due to gravitational forces, the interface between oil and water (which is horizontal) moves upward as the water content in the production fluids increases. In some embodiments, as the amount of water in the production fluids increases, the water-oil interface contacts a flow control member on the inclined wall. In some embodiments, the buoyant element has a density about equal to that of the density of water in the region, and will move upward and close the upper housing orifice. Likewise, as the amount of water content in the production fluid decreases, the buoyant element, having a density about equal to that of the density of water in the region, will move down, thus opening the upper housing orifice. The movement of the buoyant elements within the housings of the flow control members thus allows control of the influx of water. Once the buoyant element has sealed the upper housing orifice of all flow control members as a result of the movement of water, the system will close completely.

In some embodiments, the buoyant elements have a density selected based on the density of water in the downhole region.

In some embodiments, the buoyant elements have a density selected based on the density of oil in the downhole region. Thus, in some embodiments, the buoyant elements can be made with any material having a density similar to the density of water in the downhole region. In other embodiments, the buoyant elements can be made with any material having a density similar to the density of oil in the downhole region. In other embodiments, the buoyant elements can be engineered from a material in such an appropriate volume—mass ratio to match the required density, such as from light metals for instance.

The buoyant elements can be a wide variety of shapes and sizes, in some embodiments, the buoyant elements are spherical. In general, the shape of the buoyant element will be selected based on the shape of the orifice. For example, if the orifice is circular, the buoyant element can be spherical or in the shape of a bullet such that the circular orifice is closed or sealed by the buoyant element. In further embodiments, the buoyant elements are conical, or elliptical in shape. The shape of the orifice will correspond to the shape of the buoyant element such that the orifice can be sealed by the buoyant element.

The housing can be a wide variety of shapes and sizes. In some embodiments, the housing is cylindrical. In further embodiments, the inner chamber is cylindrical. In some embodiments, the housing and inner chamber are made from the same material. In general, the shape of the housing can be any shape that would allow the through flow of fluids while holding the sealing buoyant element within the inner chamber. In general, the diameter of the housing should be slightly larger than the buoyant element to allow the buoyant element to move freely move within the housing. In some embodiments, the housings are welded to the inclined wall. In other embodiments, the housings are casted with the pipe material.

The flow control members can be a wide variety of shapes and sizes. In some embodiments, all of the flow control members are the same size. In further embodiments, the flow control members are of varying sizes. A person of skill in the art will understand how to select the proper combination of number and sizes of flow control members based on downhole conditions and desired water and pressure regulation.

The flow control members can have a wide variety of physical arrangements on the inclined wall. In some embodiments, the inclined wall has three or more flow control members. In further embodiments, all of the flow control members are at different horizontal levels. In alternative embodiments, at least two flow control members are at the same horizontal level.

The arrangement of the flow control members is such that the flow of fluids in a downhole region of the apparatus can be controlled. In some embodiments, the flow control members are located at horizontal levels along the inclined wall such that the apparatus is operable to optimize the control of water entering the circular pipe in the downhole region.

The arrangement of the flow control members is such that the pressure in a downhole region of the apparatus can be controlled, in some embodiments, the flow control members are capable of inducing an overall change in pressure such that the pressure of the well bore is adjusted in a downhole region of the apparatus. In further embodiments, the pressure is equalized within the circular pipe.

In some embodiments, the buoyant element will allow the control of the production fluids from a certain region in the well through a designed orifice size that creates a differential pressure (pressure drop) that is distributed along the well to achieve a pressure distribution profile. This effect is similar to a conventional inflow control device ("ICD") used commonly in wells to equalize the wellbore pressure. In further embodiments, the presence of the buoyant element will prevent excess water from being produced from regions of a well by creating an additional pressure drop that will further control the well productivity.

Figure 2:
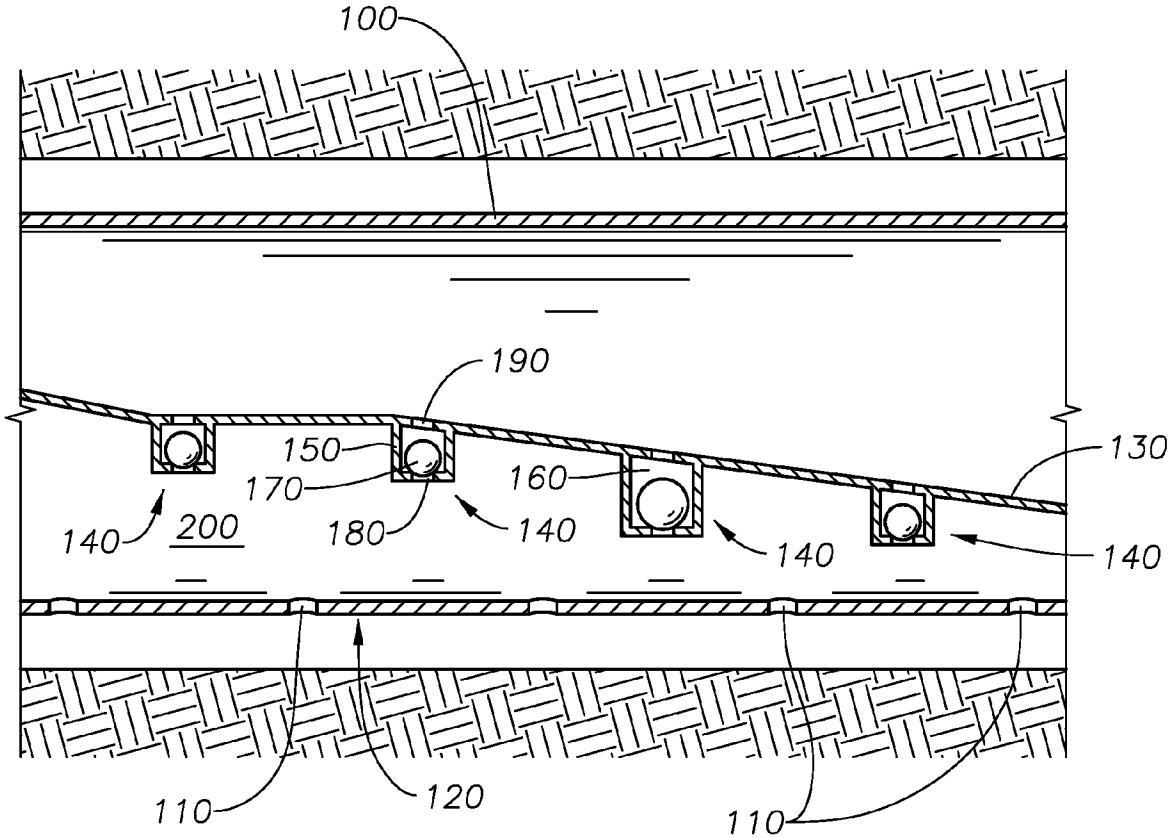
FIG. 2 shows an embodiment of a vertical cross section of an apparatus capable of controlling pressure and production fluids in a circular pipe, in accordance with an embodiment of this disclosure.

A vertical cross section of an embodiment of the apparatus is shown in FIGS. 1-2. In the vertical cross section of FIG. 1, the apparatus includes a circular pipe 100 that has at least one pipe orifice 110 on a lower side 120 of the circular pipe 100. The pipe orifice 110 allows the flow of production fluids through the orifice into the circular pipe. Within the circular pipe 100 is an inclined wall 130. The inclined wall 130 has a plurality of flow control members 140 positioned at different horizontal levels relative to the inclined wall 130. The flow control members 140 each have a housing 150 with an inner chamber 160 and a buoyant element 170 within the inner chamber 160 of the housing 150. The buoyant element 170 moves vertically within the inner chamber 160 relative to the density of the production fluids. Each housing 150 has a lower housing orifice 180 and an upper housing orifice 190. Between the pipe orifice and the inclined wall is a space 200.

In another aspect, the invention provides a process of using the apparatus in a horizontal section of an oil well. The process includes permitting production fluids to flow through the pipe orifice and enter the space. The process further includes allowing the production fluids to enter the inner chamber of the housing of a lowest positioned flow control member on the inclined wall. In entering the inner chamber, the production fluids contact the buoyant element of the flow control member at the lowest horizontal level and urge the buoyant element into a position relative to the density of the production fluids. The position of the buoyant element ranges between the lower housing orifice and the upper housing orifice of the inner chamber of the housing such that the upper housing orifice is shut off from fluid communications when the buoyant element is urged to its highest position within the inner chamber.

In some embodiments, the process can further include the step of allowing the production fluids to enter the lower housing orifice of a higher positioned flow control member on the inclined wall. The production fluids then contact the buoyant element of the higher positioned flow control members. The buoyant element moves upward and is operable to close or seal the upper housing orifice of the higher positioned flow control members on the inclined wall.

In further embodiments, the process can further include the step of regulating an influx of water in the downhole region by closing the upper housing orifice of all housings of all flow control members positioned along the inclined wall.

In other embodiments, the process further includes adjusting the pressure in the downhole region.

In further embodiments, the process further includes the step of optimizing production rates from a downhole region. In some embodiments, the process further includes the step of improving production quality from a downhole region. For instance, in some embodiments of the present invention, a benefit experienced from the invention is the creation of a controlled pressure drop along the well to achieve an equalized pressure and allow smooth oil layer depletion for a maximum sweep. In some embodiments of the present invention, the buoyant element will prevent excess water from being produced when a particular zone in the well in flooded with water or water breakthrough occurs at a certain well zone.

In some embodiments, the regions in which the apparatus is to be used are any reservoir where water wet zones are known in the well. In further embodiments, the regions in which the apparatus is to be used include carbonate reservoirs where water wet zones are known in the well.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Throughout this application, where patents or publications are referenced, the disclosures of these references in their entireties are intended to be incorporated by reference into this application, in order to more fully describe the state of the art to which the invention pertains, except when these references contradict the statements made herein.

As used herein and in the appended claims, the words "comprise," "has," and "include" and all grammatical variations thereof are each intended to have an open, non-limiting meaning that does not exclude additional elements or steps.

That which is claimed is:

1. An apparatus capable of controlling pressure and production fluids in a circular pipe in a downhole region of a well bore, the apparatus comprising:

the circular pipe comprising at least one pipe orifice on a lower side of the circular pipe, the pipe orifice operable to allow the flow of production fluids through the orifice into the circular pipe;

an inclined wall within the circular pipe, the inclined wall having a plurality of flow control members positioned at different horizontal levels relative to the inclined wall;

the flow control members each having a housing with an inner chamber and a buoyant element within the inner chamber of the housing, such that the buoyant element moves vertically within the inner chamber relative to a density of the production fluids;

each housing having a lower housing orifice and an upper housing orifice;

and a space located between the pipe orifice and the inclined wall.

2. The apparatus of claim 1, further wherein the buoyant elements have a density selected based on a density of water in the downhole region.

3. The apparatus of claim 1, further wherein the buoyant elements have a density selected based on a density of oil in the downhole region.

4. The apparatus of claim 1, wherein the buoyant elements are spherical.

5. The apparatus of claim 1, wherein the housing is cylindrical.

6. The apparatus of claim 1, wherein the flow control members are the same size.

7. The apparatus of claim 1, wherein the flow control members are of varying sizes.

8. The apparatus of claim 1, wherein the flow control members are located at horizontal levels along the inclined wall such that the apparatus is operable to optimize a control of water entering the circular pipe in the downhole region.

9. The apparatus of claim 1, wherein the flow control members are capable of inducing an overall change in pressure such that the pressure of the well bore is adjusted in a downhole region of the apparatus.

10. The apparatus of claim 1, wherein the inclined wall has three or more flow control members.

11. The apparatus of claim 10, wherein the flow control members are at different horizontal levels.

12. The apparatus of claim 10, wherein at least two flow control members are at the same horizontal level.

13. A process using the apparatus of claim 1 in a horizontal section of an oil well, the process comprising the steps of:

permitting production fluids to flow through the pipe orifice and enter the space;

allowing the production fluids to enter the inner chamber of the housing of a lowest positioned flow control member on the inclined wall, the production fluids contacting the buoyant element of the flow control member at the lowest horizontal level and urging the buoyant element into a position relative to the density of the production fluids;

the position ranging between the lower housing orifice and the upper housing orifice of the inner chamber of the housing such that the upper housing orifice is shut off from fluid communications when the buoyant element is urged to a highest position of the buoyant element within the inner chamber.

14. The process of claim 13 wherein the process further comprises the steps of:

the production fluids entering the lower housing orifice of a higher positioned flow control member on the inclined wall;

the production fluids contacting the buoyant element of the higher positioned flow control members;

the buoyant element moving upward and being operable to close the upper housing orifice of the higher positioned flow control members on the inclined wall.

15. The process of claim 13 wherein the process further comprises the steps of:

regulating an influx of water in the downhole region by closing the upper housing orifice of all housings of all flow control members positioned along the inclined wall.

16. The process of claim 13 wherein the process further comprises the step of:

adjusting the pressure in the downhole region.

17. The process of claim 13 wherein the process further comprises the step of:

adjusting the pressure in the downhole region.

18. The process of claim 13 wherein the process further comprises the step of:

optimizing production rates from a downhole region.

19. The process of claim 13 wherein the process further comprises the step of:

improving production quality from a downhole region.

* * * * *